US009486856B2

(12) United States Patent
Mangoyan

(10) Patent No.: US 9,486,856 B2
(45) Date of Patent: Nov. 8, 2016

(54) SYSTEM AND METHOD FOR MANUFACTURING RAILCAR YOKES

(71) Applicant: Ohannes Mangoyan, Glenshaw, PA (US)

(72) Inventor: Ohannes Mangoyan, Glenshaw, PA (US)

(73) Assignee: MCCONWAY & TORLEY, LLC, Dallas, TX (US)

( * ) Notice: Subject to any disclaimer, the term of this patent is extended or adjusted under 35 U.S.C. 154(b) by 190 days.

(21) Appl. No.: 14/557,595

(22) Filed: Dec. 2, 2014

(65) Prior Publication Data

US 2016/0151834 A1 Jun. 2, 2016

(51) Int. Cl.

| | |
|---|---|
| ***B22C 9/02*** | (2006.01) |
| ***B22C 9/10*** | (2006.01) |
| ***B22D 25/02*** | (2006.01) |
| ***B22D 25/00*** | (2006.01) |
| ***B22C 9/22*** | (2006.01) |

(52) U.S. Cl.

CPC ..... *B22D 25/00* (2013.01); *B22C 9/02* (2013.01); *B22C 9/10* (2013.01); *B22C 9/103* (2013.01); *B22C 9/108* (2013.01); *B22C 9/22* (2013.01); *B22D 25/02* (2013.01)

(58) Field of Classification Search

CPC ..... B22C 9/02; B22C 9/10; B22C 9/103; B22C 9/108; B22C 9/22; B22D 25/00; B22D 25/02

USPC ..... 164/129, 137, 350, 351

See application file for complete search history.

(56) References Cited

U.S. PATENT DOCUMENTS

| | | | | |
|---|---|---|---|---|
| 8,627,875 | B1 | 1/2014 | Pinkstock et al. | |
| 8,813,810 | B1 | 8/2014 | Bauer et al. | |
| 2008/0105398 | A1* | 5/2008 | Oftedahl | B22C 9/103 164/137 |
| 2014/0262101 | A1 | 9/2014 | Bauer et al. | |

FOREIGN PATENT DOCUMENTS

| | | | |
|---|---|---|---|
| EP | 2691281 | | 8/2014 |
| JP | 03018457 | A * | 1/1991 |

OTHER PUBLICATIONS

PCT Notification of Transmittal of the International Search Report and the Written Opinion of the International Searching Authority, or the Declaration for International application No. PCT/US2015/062909—Mar. 8, 2016.

* cited by examiner

*Primary Examiner* — Kevin E Yoon

(74) *Attorney, Agent, or Firm* — Baker Botts, LLP

(57) ABSTRACT

A method for manufacturing railcar yokes includes providing a cope mold portion having internal walls defining at least in part perimeter boundaries of at least two upper yoke mold cavities. The method further comprises providing a drag mold portion having internal walls defining at least in part perimeter boundaries of at least two lower yoke mold cavities. A slab core is positioned within the drag mold portion. The slab core is configured to define at least in part perimeter boundaries of the at least two upper yoke mold cavities and the at least two lower yoke mold cavities. The cope and drag mold portions are closed with the slab core therebetween. The method also comprises at least partially filling the at least two upper and at least two lower yoke mold cavities with a molten alloy to form a first, second, third, and fourth yoke.

20 Claims, 7 Drawing Sheets

SYSTEM AND METHOD FOR MANUFACTURING RAILCAR YOKES

TECHNICAL FIELD

The present disclosure is related to railcars, and more particularly to a system and method for manufacturing railcar yokes.

BACKGROUND

Railcar yokes are generally manufactured through a casting process with steel or other alloy. Conventional methods of manufacturing railcar yokes have included producing yoke castings in cavities formed across cope and drag mold portions of a casting box. The perimeter boundaries of each of these cavities are split between the cope and drag mold portions. As such, a traditional casting box cannot produce a yoke casting entirely in the cope mold portion and another yoke casting entirely in the drag mold portion.

SUMMARY

The teachings of the present disclosure relate to a system and method for manufacturing railcar yokes. In accordance with one embodiment, a method for manufacturing railcar yokes includes providing a cope mold portion having internal walls defining at least in part perimeter boundaries of at least two upper yoke mold cavities. The method further comprises providing a drag mold portion having internal walls defining at least in part perimeter boundaries of at least two lower yoke mold cavities. A slab core is positioned within the drag mold portion. The slab core is configured to define at least in part perimeter boundaries of the at least two upper yoke mold cavities and the at least two lower yoke mold cavities. The cope and drag mold portions are closed with the slab core therebetween. The method also comprises at least partially filling the at least two upper and at least two lower yoke mold cavities with a molten alloy to form a first, second, third, and fourth yokes.

Technical advantages of particular embodiments may include using a slab core in a casting box to enable the production of separate and unique stackable cores, thereby optimizing the production.

Another technical advantage of particular embodiments includes vertically stacking yoke cavities within a casting box by positioning a slab core between the cope and drag mold portions. Accordingly, at least four yokes may be produced within the casting box at a time, which in turn reduces manufacturing costs and the amount of time and labor required to cast railcar yokes. Thus, the production of railcar yokes may be optimized.

Yet another technical advantage of particular embodiments includes vent slots in the cope and drag mold portions, which facilitate solidification of the molten alloy by allowing gases to escape from the casting box.

A further technical advantage of particular embodiments may include positioning chills within the head portions of the drag and cope molds to provide desired directional solidification of the molten alloy in the yoke cavities.

Other technical advantages will be readily apparent to one of ordinary skill in the art from the following figures, descriptions, and claims included herein. Moreover, while specific advantages have been enumerated above, certain embodiments of the invention may include all, some, or none of the enumerated advantages.

BRIEF DESCRIPTION OF THE DRAWINGS

A more complete understanding of embodiments of the disclosure will be apparent from the detailed description taken in conjunction with the accompanying drawings in which.

DETAILED DESCRIPTION

Example embodiments and their advantages are best understood by referring to FIGS. 1 through 8 of the drawings.

Railcar yokes are generally manufactured through a casting process with steel or other alloy. Conventional methods of manufacturing railcar yokes have included producing yoke castings in cavities formed across cope and drag mold portions of a casting box. The perimeter boundaries of each of these cavities are split between the cope and drag mold portions. As such, a traditional casting box cannot produce a yoke casting entirely in the cope mold portion and another yoke casting entirely in the drag mold portion. The teachings of this disclosure recognize that it would be desirable to incorporate a non-metallic separator (e.g., a slab core) into a system and method for manufacturing railcar yokes to enable the production of separate and unique stackable cores, and to optimize the production of railcar yokes by creating yoke castings in the cope mold portions and other yoke castings in the drag mold portions, thereby doubling the production of railcar yokes within a casting box. FIGS. 1 through 8 below illustrate a system and method of using a slab core positioned between drag and cope mold portions of a casting box to manufacture multiple yoke castings at a time.

Figure 1:
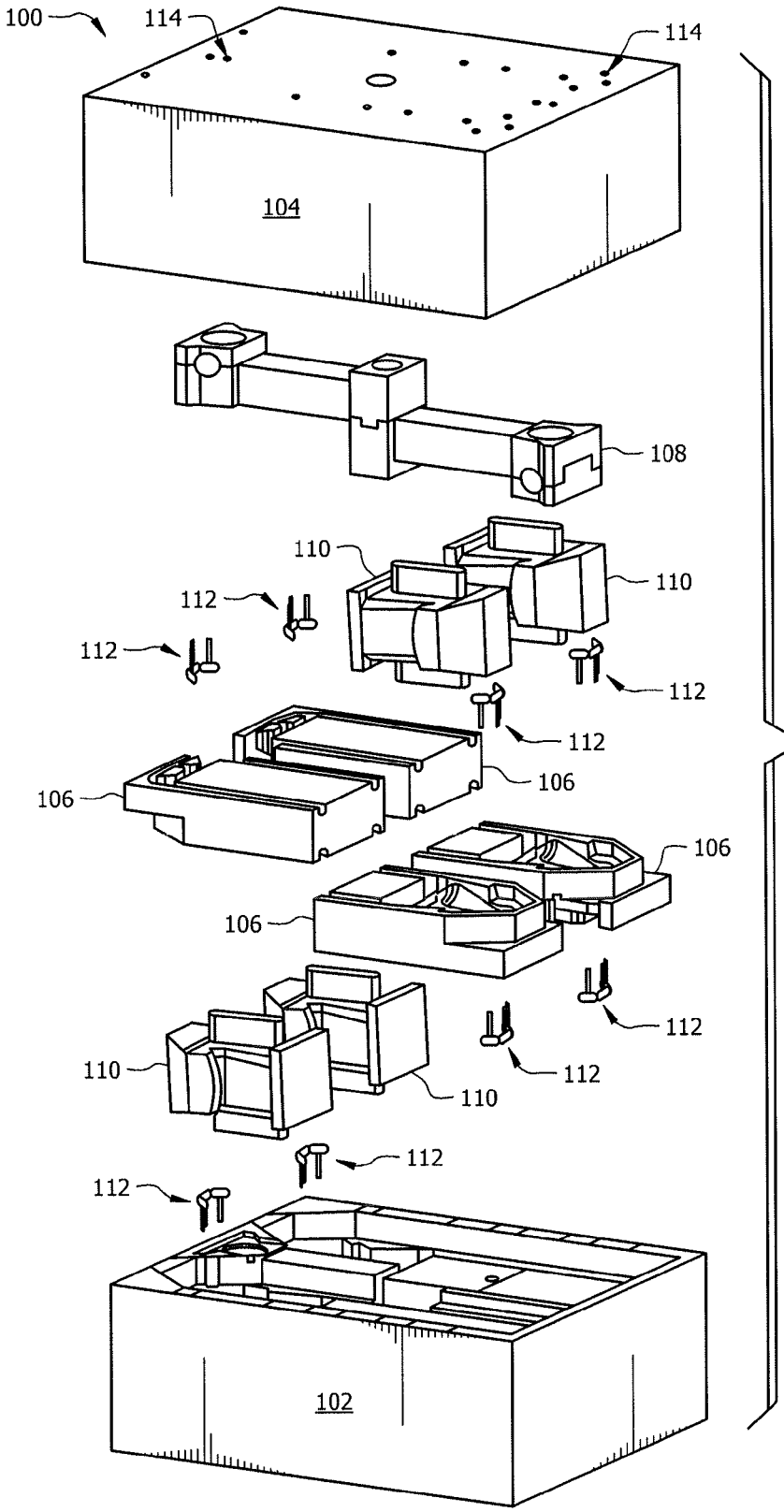
FIG. 1 illustrates an exploded view of an example manufacturing assembly, in accordance with particular embodiments.

FIG. 1 illustrates an exploded view of an example manufacturing assembly, in accordance with particular embodiments. Manufacturing assembly 100 may refer to a casting box and may be considered a double-stacked mold. In general, manufacturing assembly 100 includes a drag mold 102 and a cope mold 104 into which a molten alloy, such as liquid steel, is poured in order to manufacture cast railcar yokes. Each of drag mold 102 and cope mold 104 may include internal walls defining at least in part perimeter boundaries of yoke mold cavities ("cavities").

In general, manufacturing assembly 100 includes one or more non-metallic separators, such as one or more slab cores 106, that may be used to form multiple cavities within manufacturing assembly 100. Example slab cores 106 may comprise ceramic, fiber, graphite, plaster, sand, resin, any other refractory material, any other suitable material, and/or any combination of the preceding. In certain embodiments, slab cores 106 may be configured to define at least in part perimeter boundaries of at least four cavities. Additionally, the use of slab cores 106 may enable the production of separate and unique stackable cores within manufacturing assembly 100.

Slab cores 106 are typically positioned between drag mold 102 and cope mold 104 to separate the upper half of the casting box from the lower half of the casting box. This may allow yoke mold cavities to be vertically stacked within the casting box such that at least two yoke castings may be produced in the cope mold portion and at least two other yoke castings may be produced in the drag mold portion.

In an example embodiment, once slab cores 106 are in place, drag mold 102 and cope mold 104 may be brought together and closed along their parting line. As a result, two lower yoke cavities may be created between drag mold 102 and slab cores 106 and two upper yoke cavities may be created between cope mold 104 and slab cores 106. In other words, slab cores 106 separate drag mold 102 from cope mold 104 such that at least two yokes may be cast in drag mold 102 and at least two other yokes may be cast in cope mold 104. In certain embodiments, each cavity created in manufacturing assembly 100 may include a head portion for forming the head end section of a yoke casting, a strap portion for forming the strap sections of the yoke casting, and a butt portion for forming the butt end section of the yoke casting.

Manufacturing assembly 100 may also include a gating assembly 108, head cores 110, chills 112, and vents 114. Gating assembly 108 generally fits within drag mold 102 and receives the molten alloy for the yoke castings. In certain embodiments, gating assembly 108 may include ingates through which a liquid metal or alloy may enter the cavities. In the illustrated embodiment, manufacturing assembly 100 utilizes a top gating system that allows the molten alloy to enter at the top of manufacturing assembly 100 to promote directional solidification from the lower castings to the upper castings (e.g., the lower cavities are filled before the upper cavities are filled). Other embodiments may use other types of gating systems.

Head cores 110 are generally used to form head cavities in the yoke castings when the molten alloy solidifies around the cores. A head core 110 may comprise sand resin and/or any other suitable material. In certain embodiments, each head core 110 may form a portion of a boundary for a draft gear pocket of a yoke casting (which allows a yoke to receive a draft gear assembly that connects couplers of adjoining railcars).

Chills 112 may be utilized by manufacturing assembly 100 to provide desired directional solidification of the molten alloy in the cavities. In particular, chills 112 may facilitate solidification of the molten alloy by absorbing heat in certain portions of the cavities. Similarly, vents 114 also facilitate solidification of the molten alloy by allowing gases to escape from manufacturing assembly 100. Thus, chills 112 and vents 114 may be used to reduce the risk of undesirable holes or other voids being formed in the yoke castings.

Although FIG. 1 illustrates manufacturing assembly 100 as including one drag mold 102, one cope mold 104, four slab cores 106, one gating assembly 108, and four head cores 110, manufacturing assembly 100 may include any number of drag molds 102, cope molds 104, slab cores 106, gating assemblies 108, and head cores 110. For example, manufacturing assembly 100 may include a single slab core 106. Additionally, while FIG. 1 illustrates manufacturing assembly 100 as including a certain number of chills 112 and vents 114, manufacturing assembly 100 may include any number of chills 112 and vents 114.

Furthermore, although drag mold 102, cope mold 104, slab cores 106, gating assembly 108, and head cores 110 are illustrated as being separate components from each other, in certain embodiments, drag mold 102, cope mold 104, slab cores 106, gating assembly 108, and/or head cores 110 may be integrated with any components of FIG. 1. As an example, a head core 110 may be integrated with a slab core 106. As another example, slab cores 106 may be integrated to form a single slab core 106.

Figure 2A:
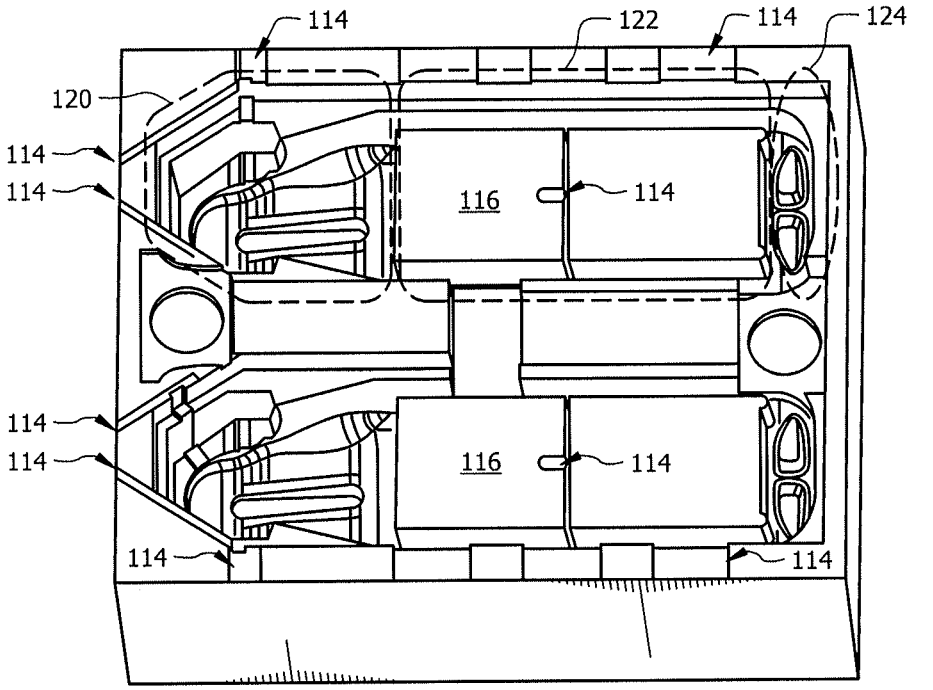
FIG. 2A illustrates a perspective view of an example drag mold for manufacturing railcar yokes, in accordance with particular embodiments.

FIG. 2A illustrates a perspective view of an example drag mold for manufacturing railcar yokes, in accordance with particular embodiments. Drag mold 102 generally comprises green sand, which may include a combination of sand, water, and/or clay. Green sand may be considered green because it is not baked in certain embodiments (e.g., there is no chemical bonding and it is not heated or treated). Other embodiments may utilize other suitable materials, such as other types of sand or plaster, to make up drag mold 102. In some embodiments, the sand casting process may include chemically bonded molds, plaster molds, no bake molds, or vacuum process molds.

As illustrated, drag mold 102 includes internal walls, formed of sand, that define at least in part perimeter boundaries of at least two yoke cavities, such as lower cavities 116, into which the molten alloy is poured and solidifies for manufacturing at least two yoke castings. Lower cavities 116 may be formed using a pattern and a high-pressure process. Each lower cavity 116 generally defines at least a portion of the exterior surfaces of a yoke casting. For example, a lower cavity 116 may correspond to the desired shape and configuration of a yoke to be cast in drag mold 102. In certain embodiments, each lower cavity 116 may include a head portion 120, a strap portion 122, and a butt portion 124. Although FIG. 2A illustrates drag mold 102 as including only two lower cavities 116, drag mold 102 may include any number of lower cavities 116. For example, drag mold 102 may comprise one lower cavity 116, three lower cavities 116, four lower cavities 116, five lower cavities 116, ten lower cavities 116, and so on.

Drag mold 102 may also include vents 114 to facilitate solidification of the molten alloy that is poured into lower cavities 116 for casting the at least two yokes. Vents 114 may be configured to allow gases produced during the manufacturing process to escape from the inside of manufacturing assembly 100. As such, gases may pass freely through vents 114 so that the gases may be transferred from inside to outside of manufacturing assembly 100, which may prevent holes from forming in the metal as it solidifies. In certain embodiments, vents 114 may refer to slots in drag mold 102. Although FIG. 2A illustrates drag mold 102 as including certain vents 114, drag mold 102 may include any number of vents 114 that may be positioned anywhere within drag mold 102.

Figure 2B:
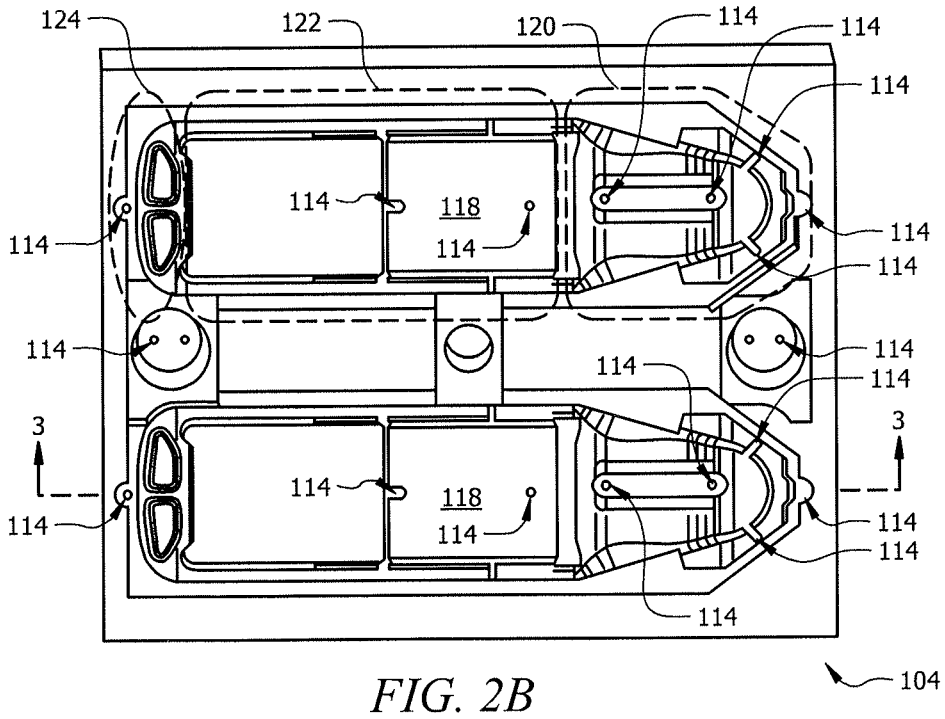
FIG. 2B is a perspective view of an example cope mold for manufacturing railcar yokes, in accordance with particular embodiments.

FIG. 2B is a perspective view of an example cope mold for manufacturing railcar yokes, in accordance with particular embodiments. According to the illustrated embodiment, a cope mold 104 may comprise green sand, which may include a combination of sand, water, and/or clay. Green sand may be considered green because it is not baked in certain embodiments (e.g., there is no chemical bonding and it is not heated or treated). Other embodiments may utilize other suitable materials, such as other types of sand, to make up cope mold 104. In some embodiments, the sand casting process may include chemically bonded molds, plaster molds, no bake molds, or vacuum process molds.

In general, cope mold 104 includes internal walls, formed of sand, that define at least in part perimeter boundaries of at least two yoke cavities, such as upper cavities 118, into which the molten alloy is poured and solidifies for manufacturing at least two other yoke castings. Upper cavities 118 may be formed using a pattern and a high-pressure process. Each upper cavity 118 generally defines at least a portion of the exterior surfaces of a yoke casting. For example, an upper cavity 118 may correspond to the desired shape and configuration of a yoke to be cast in cope mold 104. In certain embodiments, each upper cavity 118 may include a head portion 120, a strap portion 122, and a butt portion 124. Although FIG. 2B illustrates cope mold 104 as including only two upper cavities 118, cope mold 104 may include any number of upper cavities 118. For example, cope mold 104 may comprise one upper cavity 118, three upper cavities 118, four upper cavities 118, five upper cavities 118, ten upper cavities 118, and so on.

Cope mold 104 may also include vents 114 to facilitate solidification of the molten alloy that is poured into upper cavities 118 for casting the at least two other yokes. Vents 114 may be configured to allow gases produced during the manufacturing process to escape the casting box, which may prevent holes from forming in the metal as it solidifies. As such, these gases are allowed to flow through vents 114 to the outside of manufacturing assembly 100. In certain embodiments, vents 114 may refer to slots in cope mold 104. Although FIG. 2B illustrates cope mold 104 as including certain vents 114, cope mold 104 may include any number of vents 114 that may be positioned anywhere within cope mold 104.

Figure 3:
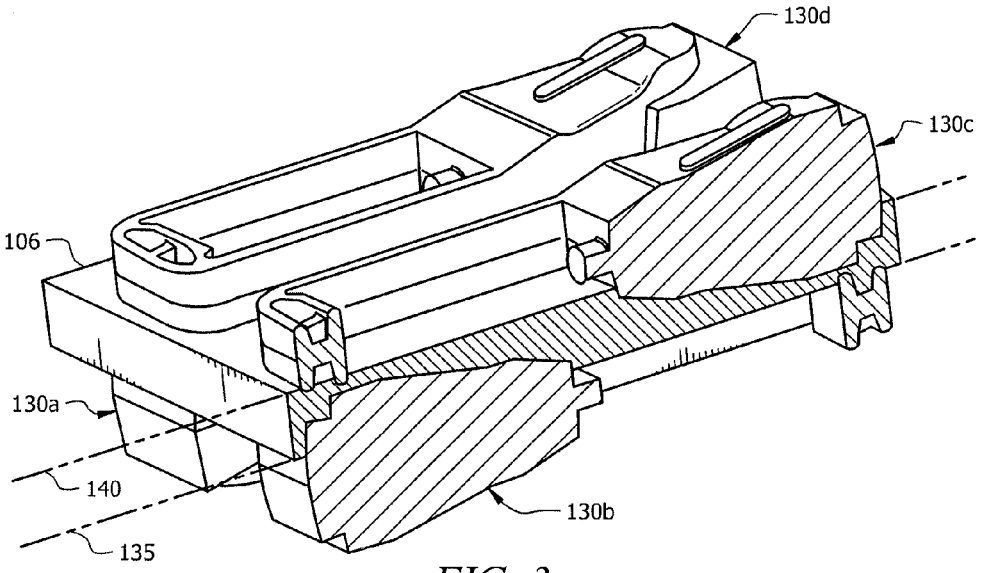
FIG. 3 illustrates a cross-section of an example slab core with yoke castings, in accordance with particular embodiments.

FIG. 3 illustrates a cross-section of an example slab core with yoke castings, in accordance with particular embodiments. A slab core 106 may refer to a non-metallic separator and may be made of ceramic, fiber, graphite, plaster, sand, resin, any other refractory material, or any other suitable material. Slab core 106 may be a single core (as illustrated by FIG. 3) or may be multiple cores (as illustrated by FIG. 1).

Slab core 106 is generally configured to separate cope and drag mold portions (e.g., separate cope mold 104 from drag mold 102), such that upper cavities 118 are isolated from lower cavities 116. By doing so, at least two yoke castings 130, such as yoke castings 130*a* and 130*b*, may be formed in portions of drag mold 102 while at least two other yoke castings 130, such as yoke castings 130*c* and 130*d*, may be formed in portions of cope mold 104.

Thus, the use of slab core 106 generally facilitates the production of separate and unique stackable cores. For example, a slab core 106 may allow for the vertical stacking of cavities within a manufacturing assembly 100. In such an example, upper cavities 118 may be stacked on top of lower cavities 116 with slab core 106 therebetween. Technical advantages of this embodiment include casting multiple yokes at a time using only one manufacturing assembly 100, which thereby reduces the cost and amount of time and labor required to cast railcar yokes.

In certain embodiments, the lower yoke castings (e.g., yoke castings 130*a* and 130*b*) may be positioned in a first direction, while the upper yoke castings (e.g., yoke castings 130*c* and 130*d*) may be positioned in a second direction. The second direction may be a direction opposite from the first direction.

According to the illustrated embodiment, positioning slab core 106 between drag and cope molds 102 and 104 may result in two or more parting lines. For example, a parting line 135 may be formed between drag mold 102 and the bottom of slab core 106, and a parting line 140 may be formed between cope mold 104 and the top of slab core 106. In certain embodiments, parting line 135 and/or parting line 140 may be offset.

In certain embodiments, the bottom side of slab core 106 may define at least in part perimeter boundaries of at least two lower yoke cavities, such as lower cavities 116. Additionally, the top side of slab core 106 may be configured to define at least in part perimeter boundaries of at least two upper yoke cavities, such as upper cavities 118. In certain embodiments, slab core 106 may include head portions, strap portions, and butt portions for each of the respective cavities, such as head portions 120, strap portions 122, and butt portions 124 of FIGS. 2A-2B.

Figure 4A:
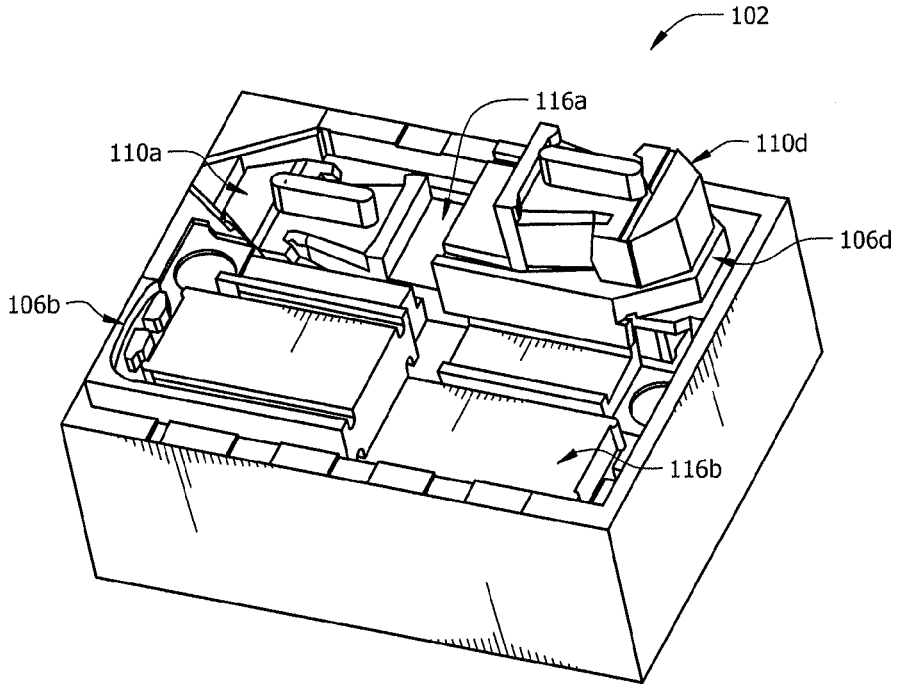
FIGS. 4A-4B illustrate example components of a manufacturing assembly positioned within a drag mold, in accordance with particular embodiments.
Figure 4B:
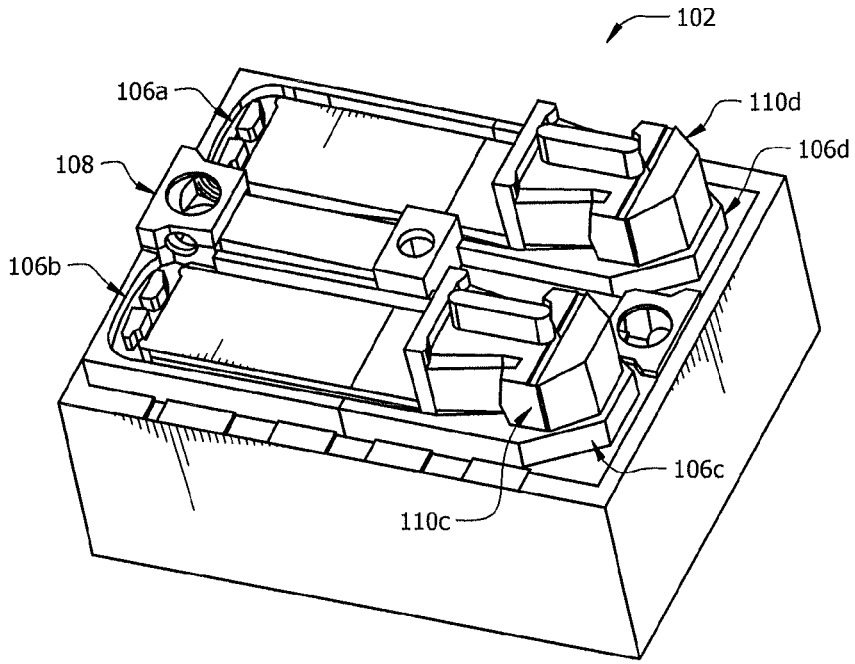

FIGS. 4A-4B illustrate example components of a manufacturing assembly positioned within a drag mold, in accordance with particular embodiments. In the typical manufacturing process of yoke castings 130, slab cores 106, gating assembly 108, and head cores 110 are placed in portions of drag mold 102 and/or cope mold 104 prior to closing manufacturing assembly 100. As described in more detail below, each of these components may be inserted and/or stacked within a certain portion of drag mold 102 and/or cope mold 104 and/or in a certain sequence.

In an example embodiment, at least two head cores 110 may first be placed in an appropriate location within drag mold 102. For example, a head core 110*a* may be positioned within a portion of drag mold 102 and another head core 110 (e.g., a head core located under slab core 106*b*) may be positioned within another portion of drag mold 102.

Slab cores 106 may then be positioned within drag mold 102 to form lower cavities 116. For example, slab cores 106*a* and 106*d* may be positioned within drag mold 102 to form lower cavity 116*a*, while slab cores 106*b* and 106*c* may be positioned within drag mold 102 to form lower cavity 116*b*. In such an example, slab core 106*a* and slab core 106*b* may be aligned with and/or coupled to head core 110*a* and another head core 110, respectively.

After slab cores 106 are placed within drag mold 102, at least two other head cores 110 may be positioned within drag mold 102 and/or coupled to slab cores 106. For example, head cores 110*c* and 110*d* may be coupled to the top of slab cores 106*c* and 106*d*, respectively.

Next, gating assembly 108 may be positioned within drag mold 102. In certain embodiments, gating assembly 108 may be inserted between slab cores 106*a* and 106*d* and slab cores 106*b* and 106*c*. Once slab cores 106, gating assembly 108, and head cores 110 have been placed within drag mold 102, cope mold 104 may be aligned with and coupled to drag mold 102 to close manufacturing assembly 100 and form upper cavities 118.

Although FIGS. 4A-4B illustrate each of slab cores 106, gating assembly 108, and head cores 110 as being separate components from drag mold 102, in certain embodiments, slab cores 106, gating assembly 108, and/or head cores 110 may be integrated with any components of FIGS. 4A-4B. Furthermore, while particular examples of positioning slab cores 106, gating assembly 108, and head cores 110 have been described, this disclosure contemplates any suitable placement of slab cores 106, gating assembly 108, and head cores 110 in any suitable order.

Figure 5A:
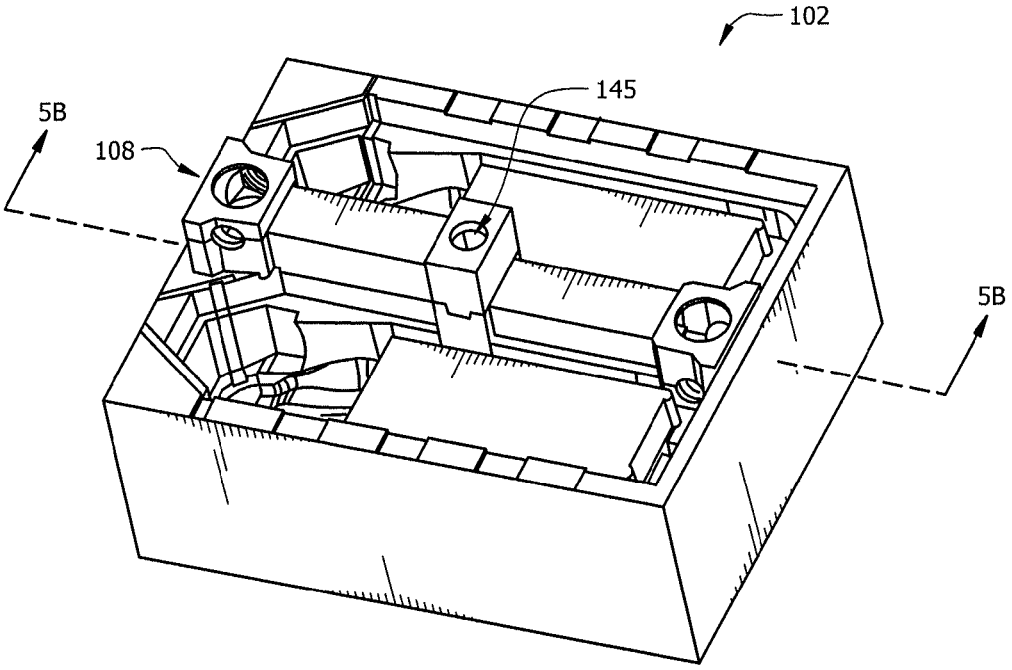
FIG. 5A illustrates a perspective view of an example gating assembly positioned within a drag mold, in accordance with particular embodiments.

FIG. 5A illustrates a perspective view of an example gating assembly positioned within a drag mold, in accordance with particular embodiments. In general, a gating assembly 108 fits within a drag mold 102 and receives the liquid alloy as it flows down into lower cavities 116 (created by drag mold 102 and slab core 106) and then into upper cavities 118 (created by cope mold 104 and slab core 106). Gating assembly 108 may be configured to allow the molten alloy to enter at the top of manufacturing assembly 100 to promote directional solidification from the lower castings to the upper castings, such as by filling lower cavities 116 before filling upper cavities 118. The present disclosure contemplates manufacturing assembly 100 including any suitable type of gating system.

In certain embodiments, gating assembly 108 includes a sprue 145. Gating assembly 108 may receive the molten alloy for the yoke castings via sprue 145. In certain embodiments, gating assembly 108 may include ingates through which the molten alloy may enter the cavities. In certain embodiments, gating assembly 108 may be coupled to one or more riser sleeves. A riser sleeve may insulate a riser portion that is formed from solidification of the liquid alloy after it flows down through lower cavities 116 and upper cavities 118.

Although particular examples of a gating assembly 108 have been described, this disclosure contemplates any suitable gating assembly 108 comprising any suitable components, according to particular needs. Also, gating assembly 108 may be separate from or integral to any component of manufacturing assembly 100.

Figure 5B:
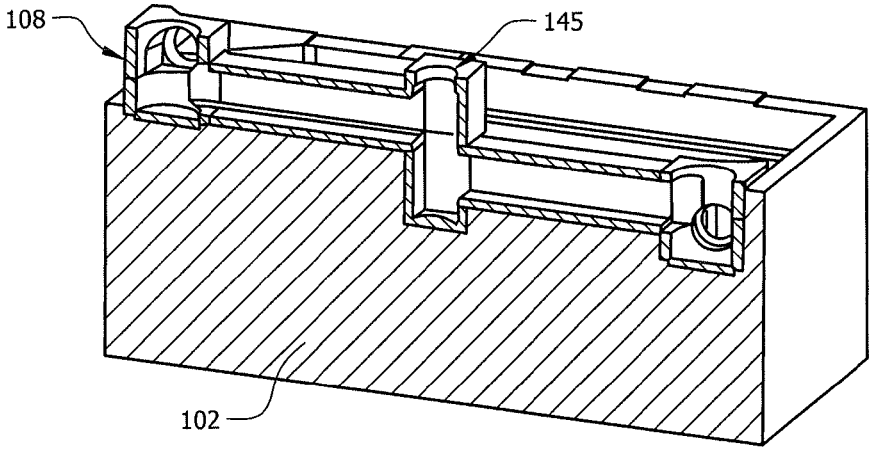
FIG. 5B illustrates a cross-section of an example gating assembly positioned within a drag mold, in accordance with particular embodiments.

FIG. 5B illustrates a cross-section of an example gating assembly positioned within a drag mold, in accordance with particular embodiments. As described above, a gating assembly 108 of manufacturing assembly 100 may include a sprue 145. Sprue 145 may be set in cope mold 104, in certain embodiments. Gating assembly 108 may also include any number of ingates.

When manufacturing the yoke castings, the molten alloy flows down through sprue 145 and enters lower cavities 116 and upper cavities 118 after flowing through ingates of gating assembly 108. The alloy flows out to lower cavities 116 and then back up into upper cavities 118. In certain embodiments, after flowing into upper cavities 118, the alloy may flow back up through one or more riser sleeves.

Although FIG. 5B illustrates gating assembly 108 as being positioned within drag mold 102, in certain embodiments, gating assembly 108 may be positioned within any component of manufacturing assembly 100. Also, gating assembly 108 may be separate from or integral to any component of manufacturing assembly 100.

Figure 6:
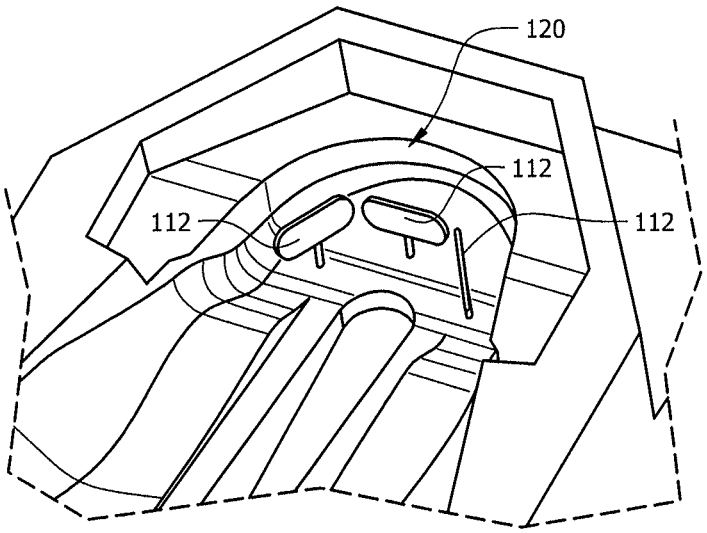
FIG. 6 illustrates a perspective view of an example placement of chills within a cavity, in accordance with particular embodiments.

FIG. 6 illustrates a perspective view of an example placement of chills within a cavity, in accordance with particular embodiments. Chills 112 may be made of steel, graphite, or other suitable metal or material. In general, chills 112 are used to prevent shrinkage cavities from forming in areas of a casting (such as a drag mold portion of a casting) that are not accessible by risers. Specifically, chills 112 may ensure casting soundness, for example, by cooling the molten alloy fast enough to avoid shrinkage cavities in the casting.

In the illustrated embodiment, chills 112 are positioned within drag mold 102 and/or cope mold 104 in a butterfly placement. The present disclosure contemplates that chills 112 may be positioned anywhere and in any placement within drag mold 102 and/or cope mold 104. In certain embodiments, chills 112 may be permanent in drag mold 102 and/or cope mold 104 and thus reusable for casting multiple yokes in the same molds.

In certain embodiments, chills 112 may assist in providing a desired directional solidification by helping to ensure that the liquid alloy solidifies from the outside of the cavities towards the inside. In certain embodiments, chills 112 may cause the molten alloy to solidify first in the head portion of the cavities (e.g., a head portion 120 of a lower cavity 116 and/or an upper cavity 118 of FIGS. 2A-2B), and then solidify from an outside to inside direction. As such, chills 112 may increase the likelihood of a consistent yoke casting (e.g., by matching the casting soundness of the drag half of the mold with the cope half of the mold).

Although FIG. 6 illustrates manufacturing assembly 100 as including only three chills 112 in a cavity, manufacturing assembly 100 may include any number of chills 112 in a cavity.

Figure 7:
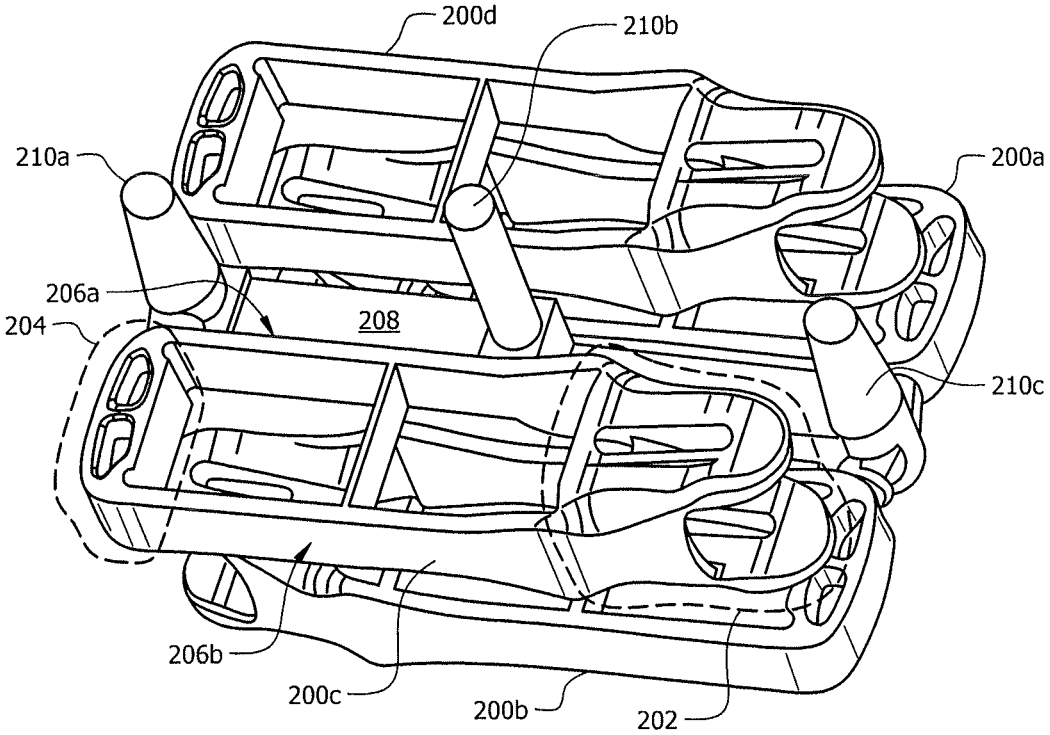
FIG. 7 illustrates a perspective view of example yoke castings formed in a manufacturing assembly, in accordance with particular embodiments.

FIG. 7 illustrates a perspective view of example yoke castings formed in a manufacturing assembly, in accordance with particular embodiments. As described above, at least four yoke castings 200 (e.g., yoke castings 200*a*, 200*b*, 200*c*, and 200*d*) are formed in manufacturing assembly 100 of FIG. 1. Each yoke casting 200 may include a head end 202 and a butt end 204 coupled to one another by straps 206 (e.g., straps 206*a* and 206*b*).

In certain embodiments, a reservoir, such as a riser sleeve, may be attached to a gating assembly 208 to prevent voids from forming in yoke castings 200 as the metal alloy shrinks upon cooling. Thus, in embodiments where manufacturing assembly 100 includes one or more riser sleeves, one or more riser portions 210 (e.g., riser portions 210*a*, 210*b*, and 210*c*) may be formed from solidification of the liquid alloy after it flows down through lower cavities 116, then upper cavities 118, and back up through the riser sleeves. In certain embodiments, these riser portions may be coupled to yoke castings 200.

In certain embodiments, the riser sleeves may allow for more even distribution of the molten alloy during solidification and may increase the likelihood of avoiding casting irregularities, for example, by reducing porosity in sections of the cavities. In such embodiments, riser portions 210 that remain after removing yoke castings 200 from manufacturing assembly 100 may be machined away. For example, riser portions 210 may be removed by being struck with a hammer or other instrument.

Figure 8:
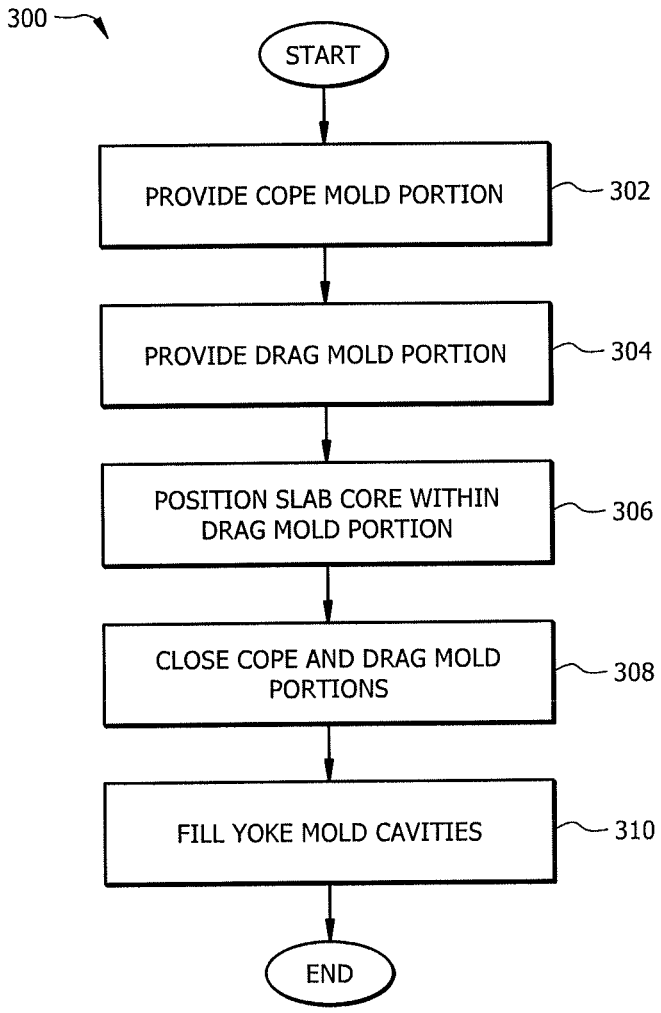
FIG. 8 illustrates an example of a method for manufacturing railcar yokes, in accordance with particular embodiments.

FIG. 8 illustrates an example of a method for manufacturing railcar yokes, in accordance with particular embodiments. In general, a method 300 facilitates producing four or more railcar yokes in a manufacturing assembly 100. In certain embodiments, one or more steps of method 300 may refer to components of manufacturing assembly 100 of FIG. 1 and may be performed by a foundryman and/or any suitable machinery.

The method begins at step 302 where a cope mold portion, such as cope mold 104, is provided. Cope mold 104 may include internal walls that define at least in part perimeter boundaries of at least two upper yoke mold cavities, such as part of upper cavities 118. In certain embodiments, cope mold 104 may also include vent slots, such as vents 114.

A drag mold portion, such as drag mold 102, may be provided at step 304. Drag mold 102 may include internal walls that define at least in part perimeter boundaries of at least two lower yoke mold cavities, such as part of lower cavities 116. In certain embodiments, drag mold 102 may also include vent slots, such as vents 114.

At step 306, a slab core, such as a slab core 106, is positioned within drag mold 102. Slab core 106 is generally configured to define at least in part perimeter boundaries of two upper yoke mold cavities, such as part of upper cavities 118, and at least in part perimeter boundaries of two lower yoke mold cavities, such as lower cavities 116. Slab core 106 may also be configured to separate drag mold 102 and cope mold 104 such that lower cavities 116 are separated from upper cavities 118. As such, at least two yoke castings 200 may be produced between drag mold 102 and slab core 106 and at least two other yoke castings 200 may be produced between cope mold 104 and slab core 106. In certain embodiments, positioning slab core 106 within drag mold 102 creates lower cavities 116. These cavities may correspond to the desired shape and configuration of two yokes to be cast between drag mold 102 and slab core 106.

In certain embodiments, one or more internal cores may be inserted in lower cavities 116 or coupled to each other and/or drag mold 102 to form various openings or cavities of one or more yoke castings 200. For example, before slab core 106 is positioned within drag mold 102, two head cores 110 may be placed at an appropriate location within drag mold 102. In particular, each head core 110 may be positioned within a respective head portion 120 of drag mold 102. Each head core 110 is generally configured to form a head cavity within a yoke casting 200.

At step 308, cope mold 104 and drag mold 102 may be closed with slab core 106 (and head cores 110) therebetween. The closing of cope mold 104 and drag mold 102 may create upper cavities 118. These cavities may correspond to the desired shape and configuration of two yokes to be cast between cope mold 104 and slab core 106.

In certain embodiments, one or more internal cores may be inserted in upper cavities 118 or coupled to each other, cope mold 102 and/or slab core 106 to form various openings or cavities of one or more yoke castings 200. For example, before closing cope mold 104 and drag mold 102, two other head cores 110 may be placed at an appropriate location within drag mold 102 and/or on top of slab core 106. In particular, each other head core 110 may be positioned within a respective head portion 120 of slab core 106. Each head core 110 may be configured to form a head cavity within a yoke casting 200.

In certain embodiments, a gating assembly, such as gating assembly 108, may be positioned within drag mold 102 before cope mold 104 and drag mold 102 are closed. Gating assembly 108 may be configured to allow the molten alloy to first enter lower cavities 116 and then enter upper cavities 118.

At step 310, lower cavities 116 and upper cavities 118 are at least partially filled, using any suitable machinery, with a molten alloy which solidifies to form the yoke castings, such as yoke castings 200. In certain embodiments, lower cavities 116 are filled with the molten alloy prior to the molten alloy flowing into upper cavities 118. For example, the molten alloy may enter and fill lower cavities 116 before entering and filling upper cavities 118. After these cavities are filled with a molten alloy, the alloy eventually cools and solidifies into yoke castings 200 having one or more features described above with respect to FIGS. 1-7.

In certain embodiments, once the yokes are cast, the cores and molds may be removed leaving yoke castings 200. Yoke castings 200 may undergo a metal finishing process that includes removing any riser portions, such as riser portions 210 of FIG. 7, and any other suitable operation.

Once the method at least partially fills lower cavities 116 and upper cavities 118, the method ends.

Some of the steps illustrated in FIG. 8 may be combined, modified, or deleted where appropriate, and additional steps may also be added to the flowchart. Additionally, steps may be performed in any suitable order without departing from the scope of the disclosure.

Teachings of the present disclosure may be satisfactorily used to manufacture railcar yokes. Modifications, additions, or omissions may be made to the systems described herein without departing from the scope of the invention. The components may be integrated or separated. As used in this document, "each" refers to each member of a set or each member of a subset of a set.

Modifications, additions, or omissions may be made to the methods described herein without departing from the scope of the invention. For example, the steps may be combined, modified, or deleted where appropriate, and additional steps may be added. Additionally, the steps may be performed in any suitable order without departing from the scope of the present disclosure.

Although the present invention and its advantages have been described in detail, it should be understood that various changes, variations, substitutions, transformations, modifications, and alterations can be made therein without departing from the spirit and scope of the invention as defined by the appended claims.

What is claimed is:

1. A method for manufacturing railcar yokes, comprising:

providing a cope mold portion, the cope mold portion having internal walls defining at least in part perimeter boundaries of at least two upper yoke mold cavities;

providing a drag mold portion, the drag mold portion having internal walls defining at least in part perimeter boundaries of at least two lower yoke mold cavities;

positioning a slab core within the drag mold portion, the slab core configured to define at least in part perimeter boundaries of the at least two upper yoke mold cavities and the at least two lower yoke mold cavities;

closing the cope and drag mold portions with the slab core therebetween; and at least partially filling the at least two upper and at least two lower yoke mold cavities with a molten alloy, the molten alloy solidifying after filling to form a first yoke, a second yoke, a third yoke, and a fourth yoke.

2. The method of claim 1, wherein the slab core is further configured to separate the cope and drag mold portions such that the at least two upper yoke mold cavities are separated from the at least two lower yoke mold cavities.

3. The method of claim 1, wherein the cope and drag mold portions comprise vent slots.

4. The method of claim 1, further comprising:

positioning a first internal core within the drag mold portion, the first internal core configured to define a first head cavity within the first yoke;

positioning a second internal core within the drag mold portion, the second internal core configured to define a second head cavity within the second yoke;

positioning a third internal core on top of the slab core, the third internal core configured to define a third head cavity within the third yoke; and positioning a fourth internal core on top of the slab core, the fourth internal core configured to define a fourth head cavity within the fourth yoke;

wherein:

the first and second internal cores are positioned within the drag mold portion before the slab core is positioned within the drag mold portion; and the third and fourth internal cores are positioned on top of the slab core after the slab core is positioned within the drag mold portion.

5. The method of claim 4, wherein the internal cores comprise a sand resin.

6. The method of claim 1, further comprising positioning a gating assembly within the drag mold portion, the gating assembly configured to allow the molten alloy to enter the at least two upper and at least two lower yoke mold cavities.

7. The method of claim 6, wherein the gating assembly is positioned within the drag mold portion before the cope and drag mold portions are closed.

8. The method of claim 1, wherein at least partially filling the at least two upper and at least two lower yoke mold cavities with the molten alloy comprises at least partially filling the at least two lower yoke mold cavities with the molten alloy before at least partially filling the at least two upper yoke mold cavities with the molten alloy.

9. The method of claim 1, wherein the slab core comprises ceramic, fiber, graphite, plaster, or sand.

10. The method of claim 1, wherein the at least two lower yoke mold cavities are positioned in a first direction and the at least two upper yoke mold cavities are positioned in a second direction.

11. A system for manufacturing railcar yokes, comprising:

a cope mold portion, the cope mold portion having internal walls defining at least in part perimeter boundaries of at least two upper yoke mold cavities;

a drag mold portion, the drag mold portion having internal walls defining at least in part perimeter boundaries of at least two lower yoke mold cavities;

a slab core, the slab core positioned within the drag mold portion, the slab core configured to define at least in part perimeter boundaries of the at least two upper yoke mold cavities and the at least two lower yoke mold cavities;

wherein:

the cope and drag mold portions are closed with the slab core therebetween; and the at least two upper and at least two lower yoke mold cavities are at least partially filled with a molten alloy, the molten alloy solidifying after filling to form a first yoke, a second yoke, a third yoke, and a fourth yoke.

12. The system of claim 11, wherein the slab core is further configured to separate the cope and drag mold portions such that the at least two upper yoke mold cavities are separated from the at least two lower yoke mold cavities.

13. The system of claim 11, wherein the cope and drag mold portions comprise vent slots.

14. The system of claim 11, further comprising:

a first internal core positioned within the drag mold portion, the first internal core configured to define a first head cavity within the first yoke;

a second internal core positioned within the drag mold portion, the second internal core configured to define a second head cavity within the second yoke;

a third internal core positioned on top of the slab core, the third internal core configured to define a third head cavity within the third yoke; and a fourth internal core positioned on top of the slab core, the fourth internal core configured to define a fourth head cavity within the fourth yoke;

wherein:

the first and second internal cores are positioned within the drag mold portion before the slab core is positioned within the drag mold portion; and the third and fourth internal cores are positioned on top of the slab core after the slab core is positioned within the drag mold portion.

15. The system of claim 14, wherein the internal cores comprise a sand resin.

16. The system of claim 11, further comprising a gating assembly positioned within the drag mold portion, the gating assembly configured to allow the molten alloy to enter the at least two upper and at least two lower yoke mold cavities.

17. The system of claim 16, wherein the gating assembly is positioned within the drag mold portion before the cope and drag mold portions are closed.

18. The system of claim 11, wherein at least partially filling the at least two upper and at least two lower yoke mold cavities with the molten alloy comprises at least partially filling the at least two lower yoke mold cavities with the molten alloy before at least partially filling the at least two upper yoke mold cavities with the molten alloy.

19. The system of claim 11, wherein the slab core comprises ceramic, fiber, graphite, plaster, or sand.

20. The system of claim 11, wherein the at least two lower yoke mold cavities are positioned in a first direction and the at least two upper yoke mold cavities are positioned in a second direction.

* * * * *